US010800991B2

(12) United States Patent
Ono

(10) Patent No.: US 10,800,991 B2
(45) Date of Patent: Oct. 13, 2020

(54) LUBRICATING OIL COMPOSITION, AND PRECISION REDUCTION GEAR USING SAME

(71) Applicant: IDEMITSU KOSAN CO., LTD., Chiyoda-ku (JP)

(72) Inventor: Takuya Ono, Aachen (DE)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/086,835

(22) PCT Filed: Mar. 31, 2017

(86) PCT No.: PCT/JP2017/013643
§ 371 (c)(1),
(2) Date: Sep. 20, 2018

(87) PCT Pub. No.: WO2017/171019
PCT Pub. Date: Oct. 5, 2017

(65) Prior Publication Data

US 2019/0106647 A1 Apr. 11, 2019

(30) Foreign Application Priority Data

Mar. 31, 2016 (JP) ..... 2016-073031

(51) Int. Cl.

| | |
|---|---|
| ***C10M 141/10*** | (2006.01) |
| ***C10M 169/04*** | (2006.01) |
| ***C10M 137/10*** | (2006.01) |
| ***C10M 135/18*** | (2006.01) |
| ***C10M 137/04*** | (2006.01) |
| ***C10M 141/12*** | (2006.01) |
| *C10M 139/00* | (2006.01) |
| *C10M 135/00* | (2006.01) |
| *C10N 30/02* | (2006.01) |
| *C10N 30/06* | (2006.01) |
| *C10N 40/06* | (2006.01) |

(52) U.S. Cl.

CPC ..... *C10M 141/10* (2013.01); *C10M 135/18* (2013.01); *C10M 137/04* (2013.01); *C10M 137/10* (2013.01); *C10M 137/105* (2013.01); *C10M 141/12* (2013.01); *C10M 169/04* (2013.01); *C10M 135/00* (2013.01); *C10M 139/00* (2013.01); *C10M 2203/024* (2013.01); *C10M 2205/0206* (2013.01); *C10M 2207/2805* (2013.01); *C10M 2219/066* (2013.01); *C10M 2219/068* (2013.01); *C10M 2223/04* (2013.01); *C10M 2223/045* (2013.01); *C10M 2223/047* (2013.01); *C10N 2030/02* (2013.01); *C10N 2030/06* (2013.01); *C10N 2040/06* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,187,723 | B1 | 2/2001 | Holt et al. | |
| 2002/0016266 | A1* | 2/2002 | Fletschinger | C10M 141/10 508/433 |
| 2008/0058235 | A1* | 3/2008 | Takigawa | C10M 169/04 508/564 |
| 2009/0054280 | A1* | 2/2009 | Sunkara | C10M 107/34 508/162 |

FOREIGN PATENT DOCUMENTS

| | | | |
|---|---|---|---|
| CN | 1962835 | A | 5/2007 |
| CN | 103113966 | A | 5/2013 |
| CN | 103695082 | A | 4/2014 |
| CN | 104974825 | A | 10/2015 |
| JP | 9-506910 | A | 7/1997 |
| JP | 4371704 | B2 | 11/2009 |
| JP | 2010-229357 | A | 10/2010 |
| JP | 2015-105289 | A | 6/2015 |
| KR | 10-2003-0000455 | A | 1/2003 |
| WO | WO 95/07964 | A1 | 3/1995 |
| WO | WO 2004/081156 | A1 | 9/2004 |
| WO | WO 2013/137160 | A1 | 9/2013 |

OTHER PUBLICATIONS

International Search Report dated Jul. 4, 2017, in PCT/JP2017/013643 filed Mar. 31, 2017.
Extended European Search Report dated Oct. 28, 2019 in European Patent Application No. 17775550.1, 8 pages.
Office Action dated Aug. 4, 2020, in Japanese Patent Application No. 2018-5096563 w/Engiish translation.

* cited by examiner

*Primary Examiner* — Cephia D Toomer
*Assistant Examiner* — Chantel L Graham
(74) *Attorney, Agent, or Firm* — Oblon, McClelland, Maier & Neustadt, L.L.P.

(57) ABSTRACT

Provided are a lubricating oil composition containing a base oil, a specific thiophosphate compound (A) and a molybdenum-based compound (B), which exhibits excellent wear resistance and has a low friction coefficient in a broad range of contact pressures ranging from high to low; and a precision reduction gear using the lubricating oil composition.

10 Claims, No Drawings

LUBRICATING OIL COMPOSITION, AND PRECISION REDUCTION GEAR USING SAME

TECHNICAL FIELD

The present invention relates to a lubricating oil composition, and a precision reduction gear using the same.

BACKGROUND ART

A lubricating oil composition for use for reduction gears of various industrial machines is required to have wear resistance for preventing wear of gears, etc.

As a method for improving wear resistance of a lubricating oil, in general, there are known a method of adding a phosphorus-sulfur-containing compound and a sulfur-containing compound to a lubricating oil (for example, see PTL 1), a method of adding a sulfur-based compound, an organic molybdenum-based compound and a phosphorus-containing compound (for example, see PTL 2), etc. As a method for reducing a friction coefficient, in general, there is known a method of adding an organic molybdenum-based compound (for example, see PTL 3).

CITATION LIST

Patent Literature

PTL 1: WO 2013/137160 A1
PTL 2: JP 2010-229357 A
PTL 3: JP 2015-105289 A

SUMMARY OF INVENTION

Technical Problem

Among various industrial machines, precision reduction gears are incorporated in joint sites and the like of industrial robots. Such precision reduction gears use a specific gear such as a planetary gear for realizing a large reduction ratio in a limited space, and the gear ratio of engaging gears (number of rack gear teeth/number of pinion gear teeth) therein is extremely large. In addition, industrial robots repeat switchover of reciprocating motion and motion speed. Accordingly, precision reduction gears for industrial robots are given an extremely larger load than that to general reduction gears. Consequently, an oil film is difficult to form in the lubrication state, therefore often resulting in boundary lubrication or mixed lubrication in many cases, and causing wear with ease to form wear debris.

In addition, for electric power cost reduction, it is desired to reduce the friction coefficient of a lubricant.

A conventional lubricating oil heretofore used in reduction gears of various industrial machines could not still attain sufficient wear resistance even though the above-mentioned compounds are added thereto. In addition, the friction coefficient could not be still sufficiently reduced even by the addition of the above-mentioned compounds.

Accordingly, an object of the present invention is to provide a lubricating oil composition capable of exhibiting excellent wear resistance in a wide range of contact pressures ranging from high to low and having a low friction coefficient, and to provide a precision reduction gear using the lubricating oil composition.

Solution to Problem

As a result of assiduous studies, the present inventors have found that, when a base oil, a thiophosphate compound having a specific structure and a molybdenum-based compound are combined, the above-mentioned problems can be solved. The present invention has been completed on the basis of this finding.

Specifically, the present invention provides the following [1] to [3].

[1] A lubricating oil composition containing a base oil, a thiophosphate compound (A) represented by the following general formula (I) and a molybdenum-based compound (B):

(I)

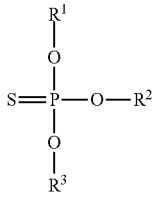

wherein $R^1$, $R^2$ and $R^3$ each independently represent an aryl group having 6 to 12 ring carbon atoms, and the aryl group may be substituted with an alkyl group having 1 to 3 carbon atoms.

[2] A precision reduction gear using the lubricating oil composition.

[3] A method for producing a lubricating oil composition, including a step of blending a base oil, a thiophosphate compound (A) represented by the above-mentioned general formula (I) and a molybdenum-based compound (B).

Advantageous Effects of Invention

According to the present invention, there are provided a lubricating oil composition capable of exhibiting excellent wear resistance in a wide range of contact pressures ranging from high to low and having a low friction coefficient, and a precision reduction gear using the lubricating oil composition.

DESCRIPTION OF EMBODIMENTS

The lubricating oil composition of the present invention contains a base oil, a thiophosphate compound (A) represented by the general formula (I) and a molybdenum-based compound (B).

From the viewpoint of more improving wear resistance, preferably, the lubricating oil composition of one embodiment of the present invention further contains a phosphate compound (C) not containing a sulfur atom.

From the viewpoint of further more improving wear resistance, more preferably, the lubricating oil composition of one embodiment of the present invention further contains a sulfur-based compound (D) containing 2 or more sulfur atoms in the molecule and not containing a phosphorus atom.

The lubricating oil composition of one embodiment of the present invention may contain any other additive for a lubricating oil than the above-mentioned components (A) to (D), for example, an antioxidant (E), within a range not detracting from the advantageous effects of the present invention.

In the lubricating oil composition of one embodiment of the present invention, the total content of the base oil, the component (A) and the component (B) is, based on the total amount of the lubricating oil composition, preferably 60.01% by mass or more, more preferably 70.01% by mass or more, even more preferably 80.01% by mass or more, further more preferably 85.01% by mass or more, especially preferably 90.01% by mass or more, and is generally 100% by mass or less, preferably 99.9% by mass or less, more preferably 99% by mass or less.

In the lubricating oil composition of one embodiment of the present invention, the total content of the base oil and the components (A) to (E) is, based on the total amount of the lubricating oil composition, preferably 70 to 100% by mass, more preferably 80 to 100% by mass, even more preferably 85 to 100% by mass, further more preferably 90 to 100% by mass, especially preferably 95 to 100% by mass.

Details of each component contained in the lubricating oil composition of the present invention are described below.

[Base Oil]

Not specifically limited, the base oil for use in the lubricating oil composition of one embodiment of the present invention may be at least one selected from mineral oils and synthetic oils that are used in ordinary lubricating oils.

Examples of the mineral oil include atmospheric residues obtained through atmospheric distillation of crude oils, or mineral oils obtained from lubricating oil fractions that are obtained through reduced pressure distillation of atmospheric residues obtained through atmospheric distillation of crude oils, in one or more treatments of solvent deasphalting, solvent extraction, hydrocracking, solvent dewaxing, catalytic dewaxing or hydrorefining; and wax-isomerized mineral oils; mineral oils obtained according to a method of isomerization of GTL (GTL is an abbreviation of gas to liquids) wax such as Fischer-Tropsch wax. Among these mineral oils, mineral oils belonging to Group II or III in grouping of base oil by API (API is an abbreviation of American Petroleum Institute) are preferred; and mineral oils belonging to Group III are more preferred.

Examples of the synthetic oil include aliphatic hydrocarbon oils (polyolefin-based synthetic oils) such as poly-α-olefins (PAO), ethylene-α-olefin copolymers, and polybutenes; aromatic hydrocarbon oils such as alkylbenzenes, and alkylnaphthalenes; glycol oils such as polyalkylene glycols; ether oils such as polyphenyl ethers, and alkyl-substituted diphenyl ethers; ester oils such as polyol esters, dibasic acid esters, and carbonates; silicone oils; fluorinated oils; and GTL. In the lubricating oil composition of one embodiment of the present invention, ester oils and polyolefin-based synthetic oils are preferred among these synthetic oils; poly-α-olefins (PAO), ethylene-α-olefin copolymers, polyol esters, dibasic acid esters, carbonates and GTL are more preferred; and poly-α-olefins (PAO) are even more preferred.

The base oil may be a single system using one kind of the above-mentioned mineral oils and synthetic oils, or may be a mixed system of two or more kinds of mineral oils, a mixed system of two or more kinds of synthetic oils, or a mixed system of one or more of mineral oils and synthetic oils.

The base oil for use in the lubricating oil composition of one embodiment of the present invention is preferably one containing a mineral oil belonging to Group II or III in base oil grouping by API, or one containing a synthetic oil, and is more preferably one containing a synthetic oil.

The kinematic viscosity at 40° C. (hereinafter may be referred to as "40° C. kinematic viscosity") of the base oil for use in the lubricating oil composition of one embodiment of the present invention is, from the viewpoint of lubricity, cooling performance and friction loss reduction in stirring, preferably 40 $mm^2/s$ or more.

The kinematic viscosity at 40° C. of the base oil is preferably 10 $mm^2/s$ or more, and 1800 $mm^2/s$ or less, more preferably 40 $mm^2/s$ or more and 1650 $mm^2/s$ or less, even more preferably 50 $mm^2/s$ or more and 1,500 $mm^2/s$ or less, further more preferably 60 $mm^2/s$ or more and 1,200 $mm^2/s$ or less, especially more preferably 70 $mm^2/s$ or more and 1,100 $mm^2/s$ or less.

The viscosity index of the base oil is, from the viewpoint of suppressing viscosity change with temperature change, preferably 60 or more, more preferably 75 or more, even more preferably 90 or more.

Here, in the case where the base oil for use in the lubricating oil composition of one embodiment of the present invention is a mixture of two or more kinds of base oils, the 40° C. kinematic viscosity and the viscosity index thereof each may fall within the above-mentioned range.

In the lubricating oil composition of one embodiment of the present invention, the kinematic viscosity and the viscosity index of the base oil and the lubricating oil composition are values measured according to JIS K2283.

The content of the base oil is, based on the total amount of the lubricating oil composition, preferably 60% by mass or more, more preferably 70% by mass or more, even more preferably 80% by mass or more, further more preferably 85% by mass or more, especially more preferably 90% by mass or more, and is preferably 99.9% by mass or less, more preferably 99.0% by mass or less, even more preferably 98.0% by mass or less.

[Thiophosphate Compound (A) Represented by General Formula (I)]

The lubricating oil composition of one embodiment of the present invention contains a thiophosphate compound (A) represented by the general formula (I). In the lubricating oil composition of one embodiment of the present invention, the component (A) includes aryl thiophosphates, and alkylaryl thiophosphates.

(I)

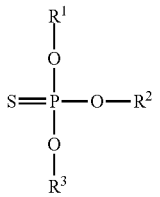

In the general formula (I), $R^1$, $R^2$ and $R^3$ each independently represent an aryl group having 6 to 12 ring carbon atoms, and the aryl group may be substituted with an alkyl group having 1 to 3 carbon atoms.

In the general formula (I), the aryl group represented by $R^1$, $R^2$ and $R^3$ includes a substituted or unsubstituted phenyl group, a substituted or unsubstituted 1-naphthyl group, a substituted or unsubstituted 2-naphthyl group, and a substituted or unsubstituted biphenyl group.

In the aryl group represented by $R^1$, $R^2$ and $R^3$, one or more hydrogen atoms that the aryl group has may be substituted with an alkyl group having 1 to 3 carbon atoms. The alkyl group having 1 to 3 carbon atoms includes a methyl group, an ethyl group, an n-propyl group, and an isopropyl group. The position of the alkyl group may be, in the case where the aryl group is a phenyl group or a biphenyl group, any of an ortho-, para- or meta-position, and in the case where the aryl group is a naphthyl group, the position may be any of an α- or β-position.

In the lubricating oil composition of one embodiment of the present invention, the component (A) is preferably a thiophosphate compound (A1) represented by the following general formula (II).

(II)

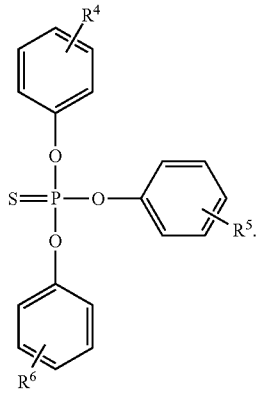

In the general formula (II), $R^4$, $R^5$ and $R^6$ each independently represent a hydrogen atom or an alkyl group having 1 to 3 carbon atoms. The alkyl group having 1 to 3 carbon atoms includes a methyl group, an ethyl group, an n-proyl group and an isopropyl group. The position of the substituents $R^4$, $R^5$ and $R^6$ may be any of an ortho-, para- or meta-position.

Specifically, the thiophosphate compound (A) represented by the general formula (II) includes tricresyl thiophosphate and triphenyl phosphorothioate.

In the lubricating oil composition of one embodiment of the present invention, one alone of the component (A) may be used or two or more kinds thereof may be used in combination.

In the lubricating oil composition of one embodiment of the present invention, the content of the component (A) is, based on the total amount of the lubricating oil composition, preferably 0.1% by mass or more and 1.0% by mass or less. More preferably, the content is 0.2% by mass or more and 0.8% by mass or less, even more preferably 0.3% by mass or more and 0.6% by mass or less. In the lubricating oil composition of one embodiment of the present invention, when the content of the component (A) is 0.1% by mass or more and 1.0% by mass or less based on the total amount of the lubricating oil composition, a lubricating oil composition can be provided which can have a low friction coefficient and have excellent wear resistance in a wide range of contact pressures ranging from high to low to such an extent that the composition can resist to lubrication conditions required for precision reduction gears to be incorporated in joint sites of industrial robots that are given an extremely large load and are readily worn to form wear debris.

In the lubricating oil composition of one embodiment of the present invention, the content of a thiophosphate compound represented by the following general formula (III) is preferably as small as possible. When the composition contains a large amount of the thiophosphate compound represented by the following general formula (III), the composition may rather cause formation of wear debris and could hardly improve wear resistance.

Accordingly, in the lubricating oil composition usable in precision reduction gears that are driven under severe lubrication conditions where a larger load than that to ordinary reduction gears will be applied to readily cause formation of wear debris, specifically, the content of the thiophosphate compound represented by the following general formula (III) is preferably 0 to 10 parts by mass, relative to 100 parts by mass of the component (A), more preferably 0 to 5 parts by mass, even more preferably 0 to 1 part by mass.

(III)

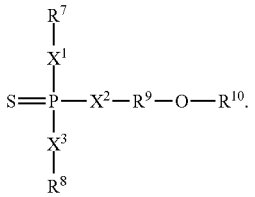

In the general formula (III), $R^7$, $R^8$ and $R^{10}$ each independently represent a linear or branched, saturated or unsaturated aliphatic hydrocarbon group having 1 to 18 carbon atoms, or a saturated or unsaturated cyclic hydrocarbon group having 5 to 18 ring carbon atoms and optionally having a substituent. $R^9$ represents a linear or branched alkylene group having 1 to 6 carbon atoms. $X^1$, $X^2$ and $X^3$ each independently represent an oxygen atom or a sulfur atom.

In the lubricating oil composition of one embodiment of the present invention, the content of a thiophosphate compound represented by the following general formula (IV) is preferably as small as possible. When the composition contains a large amount of the thiophosphate compound represented by the following general formula (IV), the composition may rather cause formation of wear debris and could hardly improve wear resistance.

Accordingly, in the lubricating oil composition usable in precision reduction gears that are driven under severe lubrication conditions where a larger load than that to ordinary reduction gears will be applied to readily cause formation of wear debris, specifically, the content of the thiophosphate compound represented by the following general formula (IV) is preferably 0 to 10 parts by mass, relative to 100 parts by mass of the component (A), more preferably 0 to 5 parts by mass, even more preferably 0 to 1 part by mass.

(IV)

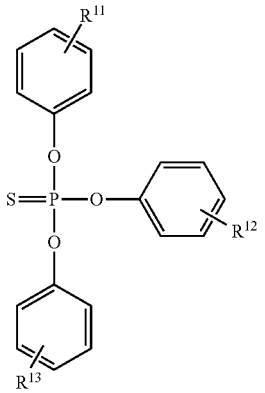

In the general formula (IV), $R^{11}$, $R^{12}$ and $R^{13}$ each independently represent a linear or branched, saturated or unsaturated aliphatic hydrocarbon group having 4 or more carbon atoms (generally having 4 to 18 carbon atoms). The position of the substituents $R^{11}$, $R^{12}$ and $R^{13}$ may be any of an ortho-, para- or meta-position.

[Molybdenum-Based Compound (B)]

The lubricating oil composition of one embodiment of the present invention contains a molybdenum-based compound (B). As the component (B), an organic molybdenum compound heretofore used as an additive for a lubricating oil be used, and examples of the organic molybdenum compound include molybdenum carbamate, molybdenum dicarbamate, molybdenum dithiophosphate (MoDTP), and molybdenum dithiocarbamate (MoDTC). For reducing a friction factor and increasing wear resistance, MoDTP and MoDTC are preferred.

As the molybdenum dithiophosphate (MoDTP), compounds represented by the following general formula (b1-1) and compounds represented by the following general formula (b1-2) are preferred.

(b1-1)

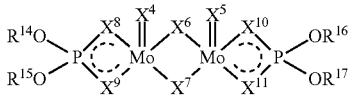

(b1-2)

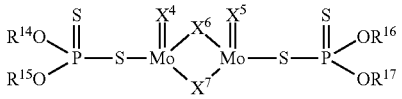

In the general formulae (b1-1) and (b1-2), $R^{14}$ to $R^{17}$ each independently represent a hydrocarbon group, and these may be the same as or different from each other.

$X^4$ to $X^{11}$ each independently represent an oxygen atom or a sulfur atom, and these may be the same as or different from each other. However, at least one of $X^4$ to $X^{11}$ in the formula (b1-1) is a sulfur atom, and at least one of $X^4$ to $X^7$ in the formula (b1-2) is a sulfur atom.

In one embodiment of the present invention, preferably, $X^4$ and $X^5$ are oxygen atoms, and $X^6$ to $X^{11}$ are sulfur atoms.

In the general formula (b1-1), form the viewpoint of improving solubility, the molar ratio of sulfur atom to oxygen atom in $X^4$ to $X^{11}$ [sulfur atom/oxygen atom] is preferably 1/4 to 4/1, more preferably 1/3 to 3/1.

In the general formula (b1-2), from the same viewpoint as above, the molar ratio of sulfur atom to oxygen atom in $X^4$ to $X^7$ [sulfur atom/oxygen atom] is preferably 1/3 to 3/1, more preferably 1.5/2.5 to 2.5/1.5.

The carbon number of the hydrocarbon group that may be selected for $R^{14}$ to $R^{17}$ is preferably 1 to 20, more preferably 3 to 18, even more preferably 4 to 16, further more preferably 5 to 12.

Specifically, examples of the hydrocarbon group that may be selected for $R^{14}$ to $R^{17}$ include an alkyl group such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group; an alkenyl group such as an octenyl group, a nonenyl group, a decenyl group, an undecenyl group, a dodecenyl group, a tridecenyl group, a tetradecenyl group, and a pentadecenyl group; a cycloalkyl group such as a cyclohexyl group, a dimethylcyclohexyl group, an ethylcyclohexyl group, a methylcyclohexyl group, a cyclohexylethyl group, a propylcyclohexyl group, a butylcyclohexyl group, and a heptylcyclohexyl group; an aryl group such as a phenyl group, a naphthyl group, an anthracenyl group, a biphenyl group, and a terphenyl group; an alkylaryl group such as a tolyl group, a dimethylphenyl group, a butylphenyl group, a nonylphenyl group, a methylbenzyl group, and a dimethylnaphthyl group; and an arylalkyl group such as a phenylmethyl group, a phenylethyl group, and a diphenylmethyl group.

The molybdenum dithiocarbamate (MoDTC) includes a binuclear molybdenum dithiocarbamate having two molybdenum atoms in one molecule, and a trinulcear molybdenum dithiocarbamate having three molybdenum atoms in one molecule.

Among these MoDTCs, a binuclear molybdenum dithiocarbamate is preferred; and compounds represented by the following general formula (b2-1) and compounds represented by the following general formula (b2-2) are more preferred.

(b2-1)

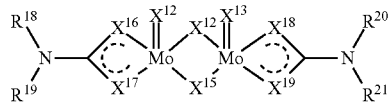

(b2-2)

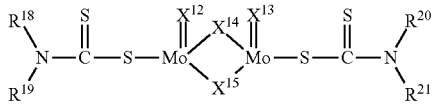

In the general formulae (b2-1) and (b2-2), $R^{18}$ to $R^{21}$ each independently represent a hydrocarbon group, and these may be the same as or different from each other.

$X^{12}$ to $X^{19}$ each independently represent an oxygen atom or a sulfur atom, and these may be the same as or different from each other.

However, at least one of $X^{12}$ to $X^{19}$ in the formula (b2-1) is a sulfur atom.

In one embodiment of the present invention, preferably, $X^{12}$ and $X^{13}$ in the formula (b2-1) are oxygen atoms and $X^{14}$ to $X^{19}$ are sulfur atoms.

Also preferably in the formula (b2-2), $X^{12}$ to $X^{15}$ in the formula (b2-2) are oxygen atoms.

In the general formula (b2-1), from the viewpoint of improving solubility, the molar ratio of sulfur atom to oxygen atom in $X^{12}$ to $X^{19}$ [sulfur atom/oxygen atom] is preferably 1/4 to 4/1, more preferably 1/3 to 3/1.

In the general formula (b2-2), from the same viewpoint as above, the molar ratio of sulfur atom to oxygen atom in $X^{12}$ to $X^{15}$ [sulfur atom/oxygen atom] is preferably 1/3 to 3/1, more preferably 1.5/2.5 to 2.5/1.5.

In the general formulae (b2-1) and (b2-2), the carbon number of the hydrocarbon group that may be selected for $R^{18}$ to $R^{21}$ is preferably 1 to 20, more preferably 3 to 18, even more preferably 4 to 16, further more preferably 5 to 12.

Specific examples of the hydrocarbon group that may be selected for $R^{18}$ to $R^{21}$ are the same as those of the hydrocarbon group that may be selected for $R^{14}$ to $R^{17}$ in the formulae (b1-1) and (b1-2).

In the lubricating oil composition of one embodiment of the present invention, one alone may be used for the component (B) or two or more kinds may be used in combination. For example, as the component (B), MoDTP and MoDTC may be used in combination.

In the lubricating oil composition of one embodiment of the present invention, the ratio by mass of the component (A) to the component (B) (component (A)/component (B)) is preferably 1/9 to 9/1, more preferably 2/8 to 8/2, even more preferably 3/7 to 7/3, further more preferably 4/6 to 6/4. In the lubricating oil composition of one embodiment of the present invention, when the ratio by mass of the component (A) to the component (B) falls within a range of 1/9 to 9/1, a lubricating oil composition can be provided which can have a low friction coefficient and have excellent wear resistance in a wide range of contact pressures ranging from high to low to such an extent that the composition can resist to lubrication conditions required for precision reduction gears to be incorporated in joint sites of industrial robots that are given an extremely large load and are readily worn to form wear debris.

[Phosphate Compound (C) Not Containing Sulfur Atom]

Preferably, the lubricating oil composition of one embodiment of the present invention further contains a phosphate compound (C) not containing a sulfur atom.

As the component (C), a triphosphate or acid phosphate compound is preferred, and a triphosphate or acid phosphate compound represented by the following general formula (c1) is more preferred.

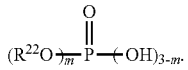

(c1)

In the general formula (c1), $R^{22}$ represents a hydrocarbon group having 2 to 24 carbon atoms, and m represents 1, 2 or 3. When m is 2 or 3, plural $R^{22}O$'s may be the same as or different from each other.

In the general formula (c1), the hydrocarbon group having 2 to 24 carbon atoms represented by $R^{22}$ includes an alkyl group having 2 to 24 carbon atoms, an alkenyl group having 2 to 24 carbon atoms, an aryl group having 6 to 24 carbon atoms, and an arylalkyl group having 7 to 24 carbon atoms.

The alkyl group having 2 to 24 carbon atoms and the alkenyl group having 2 to 24 carbon atoms may be linear, branched or cyclic, and examples thereof include an ethyl group, an n-propyl group, an isopropyl group, an n-butyl group, an isobutyl group, a sec-butyl group, a tert-butyl group, various pentyl groups, various hexyl groups, various octyl groups, various decyl groups, various dodecyl groups, various tetradecyl groups, various hexadecyl groups, various octadecyl groups, various nonadecyl groups, various eicosyl groups, various heneicosyl groups, various docosyl groups, various tricosyl groups, various tetracosyl groups, a cyclopentyl group, a cyclohexyl group, an allyl group, a propenyl group, various butenyl groups, various hexenyl groups, various octenyl groups, various decenyl groups, various dodecenyl groups, various tetradecenyl groups, various hexadecenyl groups, various octadecenyl groups, various nonadecenyl groups, various eicosenyl groups, various heneicosenyl groups, various docosenyl groups, various tricosenyl groups, various tetracosenyl groups, a cyclopentenyl group, and a cyclohexenyl group.

Examples of the aryl group having 6 to 24 carbon atoms include a phenyl group, a tolyl group, a xylyl group, a naphthyl group, and a biphenyl group. Examples of the arylalkyl group having 7 to 24 carbon atoms include a benzyl group, a phenethyl group, a naphthylmethyl group, a methylbenzyl group, a methylphenethyl group, and a methylnaphthylmethyl group.

The phosphate compound represented by the general formula (c1) is preferably one having a hydrocarbon group having 2 to 18 carbon atoms.

Specifically, the acid phosphoric monoester with m=1 includes monoethyl acid phosphate, mono-n-propyl acid phosphate, mono-n-butyl acid phosphate, mono-2-ethylhexyl acid phosphate, monododecyl acid phosphate (monolauryl acid phosphate), monotetradecyl acid phosphate (monomyristyl acid phosphate), monopalmityl acid phosphate, monooctadecyl acid phosphate (monostearyl acid phosphate), and mono-9-octadecenyl acid phosphate (monooleyl acid phosphate).

The acid phosphoric diester with m=2 includes di-n-butyl acid phosphate, di-2-ethylhexyl acid phosphate, didecyl acid phosphate, didodecyl acid phosphate (dilauroyl acid phosphate), di(tridecyl) acid phosphate, dioctadecyl acid phosphate (distearyl acid phosphate), and di-9-octadecenyl acid phosphate (dioleyl acid phosphate).

Further, the phosphoric triester with m=3 includes a triaryl phosphate, and a trialkyl phosphate; and examples thereof include mono-t-butylphenyldiphenyl phosphate, di-t-butylphenylphenyl phosphate, benzyldiphenyl phosphate, triphenyl phosphate, tricresyl phosphate, tributyl phosphate, tridecyl phosphate, ethyldibutyl phosphate, and triethylphenyl phosphate.

In the lubricating oil composition of one embodiment of the present invention, one alone may be used for the component (C) or two or more kinds may be used in combination. Further, amine salts and imide salts of these phosphate compounds may also be used.

In the case where the lubricating oil composition of one embodiment of the present invention contains the component (C), the content thereof is, based on the total amount of the lubricating oil composition, preferably 0.05% by mass or more and 1.5% by mass or less, more preferably 0.08% by mass or more and 1.2% by mass or less, even more preferably 0.1% by mass or more and 1.0% by mass or less. In the lubricating oil composition of one embodiment of the present invention, when the content of the component (C) is 0.05% by mass or more and 1.5% by mass or less, a lubricating oil composition having more excellent wear resistance in a wide range of contact pressures ranging from high to low can be provided.

[Sulfur-Based Compound (D) Containing 2 or More Sulfur Atoms in Molecule and Not Containing Phosphorus Atom]

Preferably, the lubricating oil composition of one embodiment of the present invention further contains a sulfur-based compound (D) containing 2 or more sulfur atoms in the molecule and not containing a phosphorus atom (hereinafter may be referred to as "sulfur-based compound (D)").

The sulfur-based compound (D) is preferably one that is given a rating of 2 or less in a copper corrosion test (JIS K 2513) where the compound is added to the base oil to be contained in the lubricating oil composition of one embodiment of the present invention in an amount of 1% by mass and tested under the measurement condition of 100° C. for 3 hours. The sulfur-based compound (D) given a rating of 2 or less in the copper corrosion test can better heat resistance of the lubricating oil composition. More preferably, the rating in the copper corrosion test is 1.

The sulfur-based compound (D) is preferably an organic compound containing 2 or more sulfur atoms in the molecule and not containing a phosphorus atom, and preferred examples of the sulfur-based compound (D) include a dithiocarbamate compound. Examples of the dithiocarbamate compound include an alkylenebisdialkyl dithiocarbamate. Above all, compounds having an alkylene group having 1 to 3 carbon atoms and an linear or branched, saturated or unsaturated alkyl group having 3 to 20 carbon atoms or a cyclic alkyl group having 6 to 20 carbon atoms are preferably used. Examples of such sulfur-based compounds (D) include methylenebis(dibutyldithiocarbamate), methylenebis(dioctyldithiocarbamate), and methylenebis(tridecyldithiocarbamate). Among these, from the viewpoint of improving wear resistance, methylenebis(dibutyldithiocarbamate) is preferred.

In the lubricating oil composition of one embodiment of the present invention, one alone may be used for the component (D) or two or more kinds may be used in combination.

In the case where the lubricating oil composition of one embodiment of the present invention contains a sulfur-based compound (D), the content thereof is, based on the total amount of the lubricating oil composition, preferably 0.01% by mass or more and 1% by mass or less, more preferably 0.02% by mass or more and 0.5% by mass or less, even more preferably 0.05% by mass or more and 0.3% by mass or less. In the lubricating oil composition of one embodiment of the present invention, when the content of the component (D) is 0.01% by mass or more based on the total amount of the lubricating oil composition, a lubricating oil composition having more excellent wear resistance in a wide range of contact pressures ranging from high to low can be provided. When the content of the component (D) is 1% by mass or less based on the total amount of the lubricating oil composition, sludge formation may be prevented.

The lubricating oil composition of one embodiment of the present invention may contain, as needed, any other anti-wear agent, extreme-pressure agent and the like except the components (A) to (D) within a range not detracting from the advantageous effects of the present invention. The content of the other anti-wear agent and extreme-pressure agent than the components (A) to (D) in the lubricating oil composition of one embodiment of the present invention is, relative to 100 parts by mass of the component (A), preferably 0 to 10 parts by mass, more preferably 0 to 5 parts by mass, even more preferably 0 to 1 part by mass.

In the lubricating oil composition of one embodiment of the present invention, specifically, preferred examples of the combination of the above-mentioned constituent components are embodiments of the following <1> to <3>.

<1> A lubricating oil composition containing a base oil, a component (A) and a component (B), wherein the base oil is a poly-α-olefin (PAO).

<2> A lubricating oil composition containing a base oil, a component (A), a component (B) and a component (D), wherein the base oil is a poly-α-olefin (PAO).

<3> A lubricating oil composition containing a base oil, a component (A), a component (B), a component (C) and a component (D), wherein the base oil is a poly-α-olefin (PAO).

The lubricating oil composition of one embodiment of the present invention may contain, as needed, an antioxidant within a range not detracting from the advantageous effects of the present invention.

[Antioxidant (E)]

Preferably, the lubricating oil composition of one embodiment of the present invention further contain an antioxidant (E).

As the antioxidant (E), a phenol-based antioxidant, an amine-based antioxidant and the like are preferably used.

The phenol-based antioxidant is not specifically limited, and for example, may be suitably selected any desired one from known phenol-based antioxidants heretofore used as an antioxidant for lubricating oil. Examples of the phenol-based antioxidant include 4,4'-methylenebis(2,6-di-t-butylphenol), 4,4'-bis(2,6-di-t-butylphenol), 4,4' bis(2-methyl-6-t-butylphenol), 2,2'-methylenebis(4-ethyl-6-t-butylphenol), 2,2'-methylenebis(4-methyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-t-butyl-4-methylphenol, 2,6-di-t-butyl-4-ethylphenol, 2,4-dimethyl-6-t-butylphenol, 2,6-di-t-amyl-p-cresol, 2,6-di-t-butyl-4-(N,N'-dimethylaminomethylphenol); 4,4'-thiobis(2-methyl-6-t-butylphenol), 4,4'-thiobis(3-methyl-6-t-butylphenol, 2,2'-thiobis(4-methyl-6-t-butylphenol), bis(3-methyl-4-hydroxy-5-t-butylbenzyl) sulfide, bis(3,5-di-t-butyl-4-hydroxybenzyl) sulfide, n-octyl-3-(4-hydroxy-3,5-di-t-butylphenyl)propionate, n-octadecyl-3-(4-hydroxy-3,5-di-t-butylphenyl)propionate, and 2,2'-thio[diethyl-bis-3-(3,5-di-t-butyl-4-hydroxyphenyl)propionate]. Among these, bisphenol-based antioxidants and ester group-containing phenol-based antioxidants are preferred.

Examples of the amine-based antioxidant include monoalkyldiphenylamine-based antioxidants such as monooctyldiphenylamine, and monononyldiphenylamine; dialkyldiphenylamine-based antioxidants such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; polyalkyldiphenylamine-based antioxidants such as tetrabutyldiphenylamine, tetrahexyldiphenylamine, tetraoctyldiphenylamine, and tetranonyldiphenylamine; naphthylamine-based antioxidants such as α-naphthylamine, and phenyl-α-naphthylamine; alkyl-substituted phenyl-α-naphthylamines such as butylphenyl-α-naphthylamine, pentylphenyl-α-naphthylamine, hexylphenyl-α-naphthylamine, heptylphenyl-α-naphthylamine, and octylphenyl-α-naphthylamine. Among these, dialkyldiphenylamine-based antioxidants and naphthylamine-based antioxidants are preferred.

For the antioxidant (E), one alone may be used or two or more kinds may be used in combination. For example, from the viewpoint of the effect of antioxidation, a mixture of one or more kinds of phenol-based antioxidants and one or more kinds of amine-based antioxidants is preferred.

The content of the antioxidant (E) may be appropriately controlled within a range not detracting from wear resistance, and is, based on the total amount of the lubricating oil composition, generally 0.01 to 10% by mass, preferably 0.05 to 8% by mass, more preferably 0.10 to 5% by mass.

[Other Additives]

The lubricating oil composition of one embodiment of the present invention may contain, as needed, any other additives for a lubricating oil than the components (A) to (E) (hereinafter may be simply referred to as "lubricant additives") within a range not detracting from the advantageous effects of the present invention.

Examples of such lubricant additives include a rust inhibitor, a metal deactivator, and an anti-foaming agent.

A compound having plural functions as the above-mentioned additives may also be used.

Further, one alone of various lubricant additives may be used or two or more kinds thereof may be used in combination.

The content of the lubricant additive may be appropriately controlled within a range not detracting from the advantageous effects of the present invention, and is, based on the total amount of the lubricating oil composition, generally 0.0005 to 15% by mass, preferably 0.001 to 10% by mass, more preferably 0.005 to 8% by mass.

In the lubricating oil composition of one embodiment of the present invention, the total content of these lubricant additives is, based on the total amount of the lubricating oil composition, preferably 0 to 40% by mass, more preferably 0 to 30% by mass, even more preferably 0 to 20% by mass, further more preferably 0 to 15% by mass.

The rust inhibitor includes petroleum sulfonates, alkylbenzene sulfonates, dinonylnaphthalene sulfonates, alkenylsuccinates, and polyalcohol esters. The content of the rust inhibitor is, based on the total amount of the lubricating oil composition, preferably 0.001 to 1% by mass, more preferably 0.01 to 0.5% by mass.

The metal deactivator includes benzotriazole compounds, tolyltriazole compounds, thiadiazole compounds and imidazole compounds. The content of the metal deactivator is, based on the total amount of the lubricating oil composition, preferably 0.001 to 1% by mass, more preferably 0.01 to 0.5% by mass.

The anti-foaming agent includes silicone oils, fluorosilicone oils and fluoroalkyl ethers. The content of the anti-foaming agent is, based on the total amount of the lubricating oil composition, preferably 0.01 to 1% by mass, more preferably 0.02 to 0.5% by mass.

[Method for Producing Lubricating Oil Composition]

The lubricating oil composition of one embodiment of the present invention includes a step of blending a base oil, a thiophosphate compound (A) represented by the above-mentioned general formula (I) and a molybdenum-based compound (B).

In this, as needed, a phosphate compound (C) not containing a sulfur atom, a sulfur-based compound (D) having 2 or more sulfur atoms in the molecule and not containing a phosphorus atom, an antioxidant (E), and the above-mentioned lubricant additives may be blended.

The blending amount of the components (A) to (D) is so controlled as to fall within the above-mentioned content range based on the total amount of the resultant lubricating oil composition, and the same shall apply to the other components.

After blended, the components are stirred and uniformly mixed according to a known method.

A lubricating oil composition in which a part of the components have denatured after blending or two components have reacted with each other to form a different component also belongs to the technical scope of the present invention.

[Physical Properties of Lubricating Oil Composition]

The kinematic viscosity at 40° C. of the lubricating oil composition of one embodiment of the present invention is, from the viewpoint of lubricity, cooling performance and reduction in friction loss during stirring, preferably 40 $mm^2/s$ or more.

From the same viewpoint, the kinematic viscosity at 40° C. of the lubricating oil composition of one embodiment of the present invention is preferably 40 $mm^2/s$ or more and 1650 $mm^2/s$ or less, more preferably 50 $mm^2/s$ or more and 1500 $mm^2/s$ or less, even more preferably 60 $mm^2/s$ or more and 1200 $mm^2/s$ or less, further more preferably 70 $mm^2/s$ or more and 1100 $mm^2/s$ or less.

The viscosity index of the lubricating oil composition of one embodiment of the present invention is, from the viewpoint of suppressing viscosity change with temperature change, preferably 60 or more, more preferably 70 or more, even more preferably 80 or more, further more preferably 90 or more, and especially preferably 100 or more.

In the lubricating oil composition of one embodiment of the present invention, the content of the component (B) in terms of molybdenum atom (Mo-equivalent) is, based on the total amount of the lubricating oil composition, preferably 150 ppm by mass or more and 3,000 ppm by mass or less, more preferably 170 ppm by mass or more and 2,500 ppm by mass or less, even more preferably 200 ppm by mass or more and 2,000 ppm by mass or less, further more preferably 220 ppm by mass or more and 1,000 ppm by mass or less, and especially preferably 270 ppm by mass or more and 400 ppm by mass or less. When the content of the component (B) in terms of molybdenum atom (Mo-equivalent) is 150 ppm by mass or more and 3,000 ppm by mass or less, a lubricating oil composition can be provided which can have a low friction coefficient and have excellent wear resistance in a wide range of contact pressures ranging from high to low to such an extent that the composition can resist to lubrication conditions required for precision reduction gears to be incorporated in joint sites of industrial robots that are given an extremely large load and are readily worn to form wear debris.

In the lubricating oil composition of one embodiment of the present invention, phosphorus (P) content is, based on the total amount of the lubricating oil composition, preferably 200 ppm by mass or more, more preferably 250 ppm or more and 1,000 ppm by mass or less, even more preferably 300 ppm by mass or more and 900 ppm by mass or less, further more preferably 400 ppm by mass or more and 800 ppm by mass or less, and especially preferably 400 ppm by mass or more and 620 ppm by mass or less. When the phosphorus content is 200 ppm by mass or more, a lubricating oil composition having better wear resistance can be provided. The phosphorus atom-containing compound includes the thiophosphate compound of the above-mentioned component (A) and the phosphate compound of the component (C).

In the lubricating oil composition of one embodiment of the present invention, sulfur (S) content is, based on the total amount of the lubricating oil composition, preferably 300 ppm by mass or more, more preferably 350 ppm by mass or more and 2,000 ppm by mass or less, even more preferably 400 ppm by mass or more and 1,800 ppm by mass or less, further more preferably 500 ppm by mass or more and 1,600 ppm by mass or less, and especially preferably 720 ppm by mass or more and 1,460 ppm by mass or less. When the sulfur content is 300 ppm by mass or more, a lubricating oil composition can be provided which can have more excellent wear resistance in a wide range of contact pressures ranging from high to low to such an extent that the composition can resist to lubrication conditions required for precision reduction gears to be incorporated in joint sites of industrial robots that are given an extremely large load and are readily worn to form wear debris.

Examples of the sulfur atom-containing compound include the thiophosphate compounds of the above-mentioned component (A) and the sulfur-based compounds of the component (D).

[Use of Lubricating Oil Composition]

The lubricating oil composition of one embodiment of the present invention has a low friction coefficient and has excellent wear resistance in a wide range of contact pressures ranging from high to low to such an extent that the composition can resist to lubrication conditions required for precision reduction gears to be incorporated in joint sites of industrial robots that are given an extremely large load and are readily worn to form wear debris, and therefore the lubricating oil composition can be favorably used in precision reduction gears to be incorporated in joint sites of industrial robots that are given an extremely large load and are readily worn to form wear debris,

[Precision Reduction Gear]

The precision reduction gear of one embodiment of the present invention is a precision reduction gear using the lubricating oil composition of one embodiment of the present invention. Even when wear debris is mixed in the lubricating oil composition used in the precision reduction gear of one embodiment of the present invention, the lubricating oil composition can be exchanged without disassembling the precision reduction gear, and therefore, when the precision reduction gear is incorporated in joint sites of industrial robots, the maintenance performance thereof can be improved as compared with that using grease. The precision reduction gear of one embodiment of the present invention is preferably used in industrial robots.

The precision reduction gear of one embodiment of the present invention includes a differential gear reducer such as an oscillating reduction gear, a wavy reduction gear, and an impulse reduction gear. Specifically, there are mentioned Cyclo (registered trademark) reduction gear by Sumitomo Heavy Industries, Ltd., RV reduction gear by Nabtesco Corporation, Harmonic Drive (registered trademark) by Harmonic Drive Systems Inc., etc. Regarding use thereof, the precision reduction gear of one embodiment of the present invention is used in a field that requires low backflush for precision positioning accuracy such as joint sites of robots, automatic tool exchangers in working machines, blade angle-adjusting pitch derives in wind-driven generators, and roll Yaw drives.

EXAMPLES

Next, the present invention is described in more detail with reference to Examples, but the present invention is not whatsoever limited by these Examples.

Examples 1 to 5, Comparative Examples 1 to 7

Components shown in Table 1 were blended to prepare lubricating oil composition in such a manner that the molybdenum, phosphorus and sulfur atom content therein, based on the total amount of the lubricating oil composition, could be as shown in Table 1 (% by mass, ppm by mass). The properties of the compositions are shown in Table 1. Details of the components are mentioned below. In the case where the component is dispersed in a mineral oil, the content of each component (% by mass) shown in Table 1 is the content thereof as a dispersion containing the mineral oil.

[Base Oil]

Base oil-1: poly-α-olefin (PAO) (40° C. kinematic viscosity: 17.5 $mm^2/s$, 100° C. kinematic viscosity: 3.9 $mm^2/s$, viscosity index: 117)

Base oil-2: ethylenepropylene oligomer (100° C. kinematic viscosity: 3400 $mm^2/s$)

Base oil-3: ester synthetic oil (40° C. kinematic viscosity: 102 $mm^2/s$, 100° C. kinematic viscosity: 13 $mm^2/s$, viscosity index: 124)

[Additives]

(Thiophosphate Compound Represented by General Formula (I): Component (A))

Thiophosphate compound (A1): triphenyl phosphorothioate represented by formula (V)

(V)

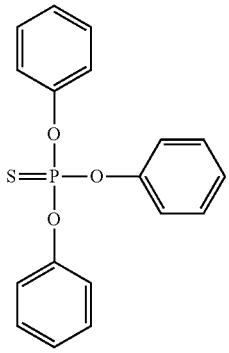

(Molybdenum-Based Compound: Component (B))

Organic molybdenum compound (B1): molybdenum dialkyldithiophosphate (MoDTP) 50% by mass, and mineral oil 50% by mass Organic molybdenum compound (B2): molybdenum dialkyldithiocarbamate (MoDTC) 50% by mass, and mineral oil 50% by mass (Phosphate Compound Not Containing Sulfur Atom: Component (C))

Phosphate compound (C1): mixture of mono-t-butylphenyldiphenyl phosphate and di-t-butylphenylphenyl phosphate (Sulfur-Based Compound having 2 or More Sulfur Atoms in Molecule and Not Containing Phosphorus Atom: Component (D))

Dithiocarbamate compound (D1): methylenebis(dibutyldithiocarbamate)

The dithiocarbamate compound (D1) was given a rating of 2 in a copper corrosion test (JIS K 2513) where the compound was added to the base oil used in the lubricating oil composition in an amount of 1% by mass and tested under the measurement condition of 100° C. for 3 hours.

(Other Additives than Components (A) to (D))

Sulfurized oils and fats: 40° C. kinematic viscosity; 10 $mm^2/s$, 100° C. kinematic viscosity; 3 $mm^2/s$, sulfur content; 38.5% by mass Thiophosphate compound (A'2): tris(2,4-$C_{9-10}$ isoalkylphenyl)thiophosphate Phenol-based antioxidant (E1): octadecyl-3-(3,5-di-t-butyl-4-hydroxyphenyl)propionate Amine-based antioxidant (E2): monobutylphenylmonooctylphenylamine Rust inhibitor: alkenylsuccinates Copper deactivator: benzotriazole Anti-foaming agent: silicone 1% by mass and mineral oil 99% by mass

[Viscosity and Viscosity Index of Lubricating Oil Composition]

The lubricating oil compositions shown in Table 1 were so controlled that the viscosity thereof could satisfy VG100 of the ISO viscosity grade. The lubricating oil compositions shown in Table 1 were so controlled that the viscosity index thereof could be 160 to 240.

The properties of the base oils, the constituent components and the lubricating oil compositions were measured according to the following methods.

(1) Kinematic Viscosity

Kinematic viscosity at 40° C. and 100° C. was measured according to JIS K 2283.

(2) Viscosity Index

Measured according to JIS K 2283.

(3) Content of Molybdenum Atom, Phosphorus Atom, and Sulfur Atom

The content of molybdenum atom and phosphorus atom was measured according to JPI-5S-38-03, and the content of sulfur atom was measured according to JIS K2541-6.

The lubricating oil compositions of Examples 1 to 5 and Comparative Examples 1 to 7 shown in Table 1 were tested in a friction test according to the method mentioned below, and the properties thereof were evaluated. The evaluation results are shown in Table 1.

[Frictional Wear Test Under Line Contact Condition (1)]

Using a reciprocating friction tester (SRV friction tester by Optimol Corporation) described in DIN51834, and using a cylinder as the upper test piece and a disc as a lower test piece, the lubricating oil compositions of Examples 1 to 5 and Comparative Examples 1 to 7 were tested in a friction test under the condition mentioned below to measure the friction coefficient thereof in 120 minutes after the start of the test, and in addition, the wear width (mm) on the cylinder was measured. A smaller value means more excellent wear resistance.

Cylinder: diameter 15 mm, length 22 mm, material AISI52100

Disc: diameter 24 mm, thickness 7.8 mm, material AISI52100

Frequency: 50 Hz

Amplitude: 1.0 mm

Load: 300 N

Temperature: 50° C.

Test time: 120 minutes

[Frictional Wear Test Under Point Contact Condition (2)]

Using a reciprocating friction tester (SRV friction tester by Optimol Corporation) described in DIN51834, and using a ball as the upper test piece and a disc as a lower test piece, the lubricating oil compositions of Examples 1 to 5 and Comparative Examples 3 and 7 were tested in a friction test under the condition mentioned below to measure the friction coefficient thereof in 120 minutes after the start of the test, and in addition, the wear mark expansion on the ball was measured in the X (lateral) direction and the Y (longitudinal) direction using a microscope. The data were averaged to give a wear mark diameter (mm). A smaller value means more excellent wear resistance.

Ball: diameter 10 mm, material AISI52100

Disc: diameter 24 mm, thickness 7.8 mm, material AISI52100

Frequency: 50 Hz

Amplitude: 1.0 mm

Load: 300 N

Temperature: 50° C.

Test time: 120 minutes

TABLE 1

| | | | | Example 1 | Example 2 | Example 3 | Example 4 | Example 5 | Comparative Example 1 | Comparative Example 2 |
|---|---|---|---|---|---|---|---|---|---|---|
| Base Oil | Base Oil-1 | | mass % | 76.05 | 75.91 | 75.95 | 75.71 | 75.61 | 76.54 | 76.60 |
| | Base Oil-2 | | mass % | 12.00 | 12.00 | 12.00 | 12.00 | 12.00 | 12.00 | 12.00 |
| | Base Oil-3 | | mass % | 10.00 | 10.00 | 10.00 | 10.00 | 10.00 | 10.00 | 10.00 |
| Additives | Thiophosphate represented by general formula (I) (A1) | | mass % | 0.45 | 0.45 | 0.45 | 0.45 | 0.45 | — | — |
| | Molybdenum-based Compound (B1) | | mass % | 0.30 | 0.44 | — | 0.44 | 0.44 | — | — |
| | Molybdenum-based Compound (B2) | | mass % | — | — | 0.40 | — | — | — | — |
| | Phosphate Compound (C1) | | mass % | — | — | — | — | 0.10 | — | — |
| | Sulfur-based Compound having 2 or more sulfur atoms in molecule and not containing phosphorus atom (D1) | | mass % | — | — | — | 0.20 | 0.20 | — | 0.20 |
| Other Additives than Components (A) to (D) | Sulfurized Oils and Fats | | mass % | — | — | — | — | — | 0.26 | — |
| | Thiophosphate (A'2) | | mass % | — | — | — | — | — | — | — |
| | Phenol-based Antioxidant (E1) | | mass % | 0.50 | 0.50 | 0.50 | 0.50 | 0.50 | 0.50 | 0.50 |
| | Amine-based Antioxidant (E2) | | mass % | 0.50 | 0.50 | 0.50 | 0.50 | 0.50 | 0.50 | 0.50 |
| | Rust Inhibitor | | mass % | 0.05 | 0.05 | 0.05 | 0.05 | 0.05 | 0.05 | 0.05 |
| | Copper Deactivator | | mass % | 0.05 | 0.05 | 0.05 | 0.05 | 0.05 | 0.05 | 0.05 |
| | Anti-foaming Agent | | mass % | 0.10 | 0.10 | 0.10 | 0.10 | 0.10 | 0.10 | 0.10 |
| Total | | | mass % | 100.00 | 100.00 | 100.00 | 100.00 | 100.00 | 100.00 | 100.00 |
| Properties | Molybdenum (Mo) Content*1 | | mass ppm | 270 | 400 | 400 | 400 | 400 | — | — |
| | Phosphorus (P) Content*2 | | mass ppm | 500 | 550 | 400 | 550 | 620 | — | — |
| | Sulfur (S) Content*3 | | mass ppm | 720 | 860 | 880 | 1460 | 1460 | 1000 | 600 |
| Frictional Wear Test | (1) Frictional wear test under line contact condition (upper test piece: cylinder, lower test piece: disc) | Friction Coefficient | | 0.07 | 0.08 | 0.10 | 0.08 | 0.08 | 0.13 | 0.14 |
| | | Wear Mark Width | mm | 0.19 | 0.19 | 0.18 | 0.18 | 0.18 | 0.27 | 0.25 |
| | (2) Frictional wear test under point contact condition (upper test piece: ball, lower test piece: disc) | Friction Coefficient | | 0.08 | 0.08 | 0.09 | 0.08 | 0.08 | seizure and stop | 0.14 |
| | | Wear Mark Diameter | mm | 0.49 | 0.51 | 0.52 | 0.50 | 0.50 | un-measurable | 0.94 |

| | | | Comparative Example 3 | Comparative Example 4 | Comparative Example 5 | Comparative Example 6 | Comparative Example 7 |
|---|---|---|---|---|---|---|---|
| Base Oil | Base Oil-1 | mass % | 76.27 | 76.40 | 76.30 | 75.84 | 76.35 |
| | Base Oil-2 | mass % | 12.00 | 12.00 | 12.00 | 12.00 | 12.00 |
| | Base Oil-3 | mass % | 10.00 | 10.00 | 10.00 | 10.00 | 10.00 |

TABLE 1-continued

| | | | | | | | |
|---|---|---|---|---|---|---|---|
| Additives | Thiophosphate represented by general formula (I) (A1) | mass % | — | — | — | — | 0.45 |
| | Molybdenum-based Compound (B1) | mass % | — | — | 0.50 | — | — |
| | Molybdenum-based Compound (B2) | mass % | — | 0.40 | — | — | — |
| | Phosphate Compound (C1) | mass % | 0.53 | — | — | — | — |
| | Sulfur-based Compound having 2 or more sulfur atoms in molecule and not containing phosphorus atom (D1) | mass % | — | — | — | — | — |
| Other Additives than Components (A) to (D) | Sulfurized Oils and Fats | mass % | — | — | — | — | — |
| | Thiophosphate (A'2) | mass % | — | — | — | 0.96 | — |
| | Phenol-based Antioxidant (E1) | mass % | 0.50 | 0.50 | 0.50 | 0.50 | 0.50 |
| | Amine-based Antioxidant (E2) | mass % | 0.50 | 0.50 | 0.50 | 0.50 | 0.50 |
| | Rust Inhibitor | mass % | 0.05 | 0.05 | 0.05 | 0.05 | 0.05 |
| | Copper Deactivator | mass % | 0.05 | 0.05 | 0.05 | 0.05 | 0.05 |
| | Anti-foaming Agent | mass % | 0.10 | 0.10 | 0.10 | 0.10 | 0.10 |
| Total | | mass % | 100.00 | 100.00 | 100.00 | 100.00 | 100.00 |
| Properties | Molybdenum (Mo) Content*1 | mass ppm | — | 400 | 450 | — | — |
| | Phosphorus (P) Content*2 | mass ppm | 400 | — | 170 | 400 | 400 |
| | Sulfur (S) Content*3 | mass ppm | — | 460 | 500 | 420 | 420 |
| Frictional Wear Test | (1) Frictional wear test under line contact condition (upper test piece: cylinder, lower test piece: disc) | Friction Coefficient | 0.15 | 0.11 | 0.08 | 0.12 | 0.14 |
| | | Wear Mark Width mm | 0.20 | 0.24 | 0.26 | 0.36 | 0.20 |
| | (2) Frictional wear test under point contact condition (upper test piece: ball, lower test piece: disc) | Friction Coefficient | 0.13 | 0.13 | 0.11 | 0.14 | 0.12 |
| | | Wear Mark Diameter mm | 0.96 | 0.88 | 0.71 | 0.92 | 0.52 |

*1The molybdenum (Mo) content is a molybdenum atom-equivalent content based on the total amount of the composition (content of the molybdenum atom contained in the molybdenum-based compound).
*2The phosphorus (P) content is the total content of the phosphor atoms contained in the additives used.
*3The sulfur (S) content is the total content of the sulfur atoms contained in the additives used.

As in Table 1, in the test (1), Examples 1 to 5 had a small wear mark width and had excellent wear resistance as compared with Comparative Examples 1 to 7.

Also in the test (2) where the contact pressure was larger than in the test (1), the wear mark diameter in Examples 1 to 5 was small as compared with that in Comparative Examples 2 to 7 where the wear mark diameter could be measured, therefore also resulting in that Examples 1 to 5 had excellent wear resistance. In Comparative Example 1, wear was so large as to cause seizure, and therefore the friction coefficient and the wear mark diameter could not be measured.

Both in the test (1) and the test (2), Examples 1 to 5 had a low friction coefficient, and the fluctuation in the friction coefficient in the test (1) and the test (2) (namely, the fluctuation in the friction coefficient in a wide range of contact pressures ranging from high to low) was small. In the sites of industrial robots, the contact pressure may greatly vary depending on the application site, and therefore a lubricating oil composition whose friction coefficient fluctuation depending on contact pressures is small can be used in a wide range and is excellent in handleability.

As opposed to these, all in Comparative examples 1 to 3, 6 and 7, the friction coefficient was large, and further, in Comparative Examples 1, 3, 6 and 7, the fluctuation in the friction coefficient in the test (1) and the test (2) was large. Further, in Comparative Examples 4 and 5, the friction coefficient was relatively small, but the fluctuation in the friction coefficient in the test (1) and the test (2) was large.

Examples 4 and 5 contained the component (C1) and the component (D1), and therefore, it is known that, in these, the friction mark width and the friction mark diameter were further small and the wear resistance improved.

Accordingly, the results in Examples 1 to 5 are that the lubricating oil compositions had excellent wear resistance and had a low friction coefficient in a wide range of contact pressures ranging from high to low.

INDUSTRIAL APPLICABILITY

The present invention can provide a lubricating oil composition which has a low friction coefficient and has excellent wear resistance in a wide range of contact pressures ranging from high to low to such an extent that the composition can resist to lubrication conditions required for precision reduction gears to be incorporated in joint sites of industrial robots that are given an extremely large load and are readily worn to form wear debris. The precision reduction gear of the present invention is a precision reduction gear that uses a lubricating oil composition having a low friction coefficient and excellent in wear resistance, and therefore, even when wear debris is mixed in the lubricating oil composition, the lubricating oil composition can be exchanged without disassembling the precision reduction gear, that is, the maintenance performance of the precision reduction gear using the lubricating oil composition of the present invention is better than a case using grease, and consequently, the precision reduction gear of the present invention is useful for industrial robots.

The invention claimed is:

1. A lubricating oil composition, comprising:

a base oil;

a thiophosphate compound (A), which is selected from the group consisting of tricresyl thiophosphate and triphenyl phosphorothioate; and a molybdenum-based compound (B), which is selected from the group consisting of molybdenum carbamate, molybdenum dicarbamate, molybdenum dithiophosphate, and molybdenum dithiocarbamate, wherein the content of the component (A) is 0.3% by mass or more and 0.6% by mass or less based on the total amount of the lubricating oil composition, and wherein the content of the component (B) in terms of molybdenum atom is 220 ppm by mass or more and 1,000 ppm by mass or less based on the total amount of the lubricating oil composition.

2. The lubricating oil composition according to claim 1, further containing a phosphate compound (C) not containing a sulfur atom.

3. The lubricating oil composition according to claim 2, wherein the content of the component (C) is 0.05% by mass or more and 1.5% by mass or less based on the total amount of the lubricating oil composition.

4. The lubricating oil composition according to claim 1, further comprising a sulfur-based compound (D) containing 2 or more sulfur atoms in the molecule and not containing a phosphorus atom.

5. The lubricating oil composition according to claim 4, wherein the content of the component (D) is 0.01% by mass or more and 1% by mass or less based on the total amount of the lubricating oil composition.

6. The lubricating oil composition according to claim 1, which as a kinematic viscosity at 40° C. of 40 $mm^2/s$ or more.

7. The lubricating oil composition according to claim 1, which is used in precision reduction gears.

8. A precision reduction gear, comprising the lubricating oil composition of claim 1.

9. The precision reduction gear of claim 8, which is incorporated in industrial robots.

10. A method for producing a lubricating oil composition, the method comprising blending:

a base oil;

a thiophosphate compound (A), which is selected from the group consisting of tricresyl thiophosphate and triphenyl phosphorothioate; and, a molybdenum-based compound (B), which is selected from the group consisting of molybdenum carbamate, molybdenum dicarbamate, molybdenum dithiophosphate, and molybdenum dithiocarbamate, to obtain the lubricating oil composition, wherein the content of the component (A) is 0.3% by mass or more and 0.6% by mass or less based on the total amount of the lubricating oil composition, and wherein the content of the component (B) in terms of molybdenum atom is 220 ppm by mass or more and 1,000 ppm by mass or less based on the total amount of the lubricating oil composition.

* * * * *